US007665929B2

(12) United States Patent
Barker, III et al.

(10) Patent No.: US 7,665,929 B2
(45) Date of Patent: Feb. 23, 2010

(54) STARTING GATE FOR BMX AND MOUNTAIN BIKE RACING

(75) Inventors: Pierce Barker, III, Cherry Valley, IL (US); Edmund W. Doherty, Jr., Oregon, IL (US); Roger Johns, Lisle, IL (US)

(73) Assignee: ProStuff LLC, Rockford, IL (US)

( * ) Notice: Subject to any disclaimer, the term of this patent is extended or adjusted under 35 U.S.C. 154(b) by 50 days.

(21) Appl. No.: 11/739,977

(22) Filed: Apr. 25, 2007

(65) Prior Publication Data

US 2007/0248409 A1 Oct. 25, 2007

Related U.S. Application Data

(60) Provisional application No. 60/745,600, filed on Apr. 25, 2006.

(51) Int. Cl.
*E01F 13/04* (2006.01)

(52) U.S. Cl. ..... 404/6; 404/9; 404/10; 49/29; 49/49

(58) Field of Classification Search ..... 49/23, 49/33, 49, 131; 404/6, 9, 10; 256/26, 73
See application file for complete search history.

(56) References Cited

U.S. PATENT DOCUMENTS 3,994,491 A * 11/1976 Mascotte et al. ..... 472/85
4,134,230 A * 1/1979 Roy ..... 49/49
5,466,088 A * 11/1995 Nasatka ..... 404/6
2005/0069383 A1 * 3/2005 Gunderson ..... 404/6
2006/0029467 A1 * 2/2006 Johnson ..... 404/60
2007/0207868 A1 * 9/2007 Burry et al. ..... 472/85
2008/0222960 A1 * 9/2008 Williams et al. ..... 49/324

* cited by examiner

*Primary Examiner*—Gary S Hartmann
(74) *Attorney, Agent, or Firm*—Reinhart Boerner Van Deuren

(57) ABSTRACT

A starting gate apparatus and method for use in bicycle races is provided. The starting gate includes a main platform, a plurality of gates connected to the main platform and a gate actuation arrangement to drive the gates from a bike stopping position to a bike releasing position. The gate actuation arrangement permits variations in at least one gate actuation parameter including an intermediate stopping position along a gate travel path, the driving force of the gate along the gate travel path, and/or an interval between initiation of an actuation sequence and actuation of the gate of the starting gate. Embodiments of the gate actuation arrangement permit a gate to independently act on an obstruction, provide for reversing, momentarily actuation of the gate during gate actuation or varying the duration or disposition of the interval of the gate actuation sequence.

12 Claims, 7 Drawing Sheets

STARTING GATE FOR BMX AND MOUNTAIN BIKE RACING

CROSS-REFERENCE TO RELATED PATENT APPLICATIONS

This patent application claims the benefit of U.S. Provisional Patent Application No. 60/745,600, filed Apr. 25, 2006, the teachings and disclosure of which are hereby incorporated in their entireties by reference thereto.

FIELD OF THE INVENTION

This invention generally relates to starting gates, and more particularly to starting gates for bicycle races.

BACKGROUND OF THE INVENTION

Bicycle races such as BMX races and mountain bike races use a starting gate to line-up competing racers behind a starting line and to prevent individual racers from getting a head-start or other advantage relative to the other racers. To align the racers, the starting gate includes one or more gates that extend(s) generally upright to confine the racers behind the starting line defined by the gate. Prior to the race beginning, the racers line-up behind the gate and press their front wheel against the gate and once the gate drops, the racers are released and the race begins.

Some gates are large enough to line-up eight racers at one time. These gates can be up to twenty four feet long and, as they are typically made with steel or other metal, an individual frame can weigh between 150 to 600 pounds. The gate is powered by one or more actuators that rotate the gate from, typically, a ninety degree orientation to a zero degree orientation in approximately twenty-five hundredths of a second, generating a very large angular velocity. As a result of the high angular velocity and the large weight, the gate has a large inertia and momentum. When the gate hits the ground or other portions of the frame of the starting gate, the gate can make a loud banging noise in excess of 100 db measured in the A scale at the riders position. This noise that can be startling and intimidating to racers, particularly younger racers. This large contact force can also be damaging to the starting gate.

Additionally, because the gate has such large inertia and momentum, objects that accidentally get in the path of the gate can be crushed and damaged. This can be very dangerous if a racer loses his balance and falls over the gate prior to the gate dropping to the zero degree orientation. The gate can cause serious injury to the racer if the gate falls on the racer. This potential injury provides an additional fear to younger racers.

Other starting gates implemented mechanical releases or pneumatically driven individual gates for individual racers with an individual actuator driving each gate. As such, the starting gate could include up to eight individual gates that are driven by eight separate actuators such that if an object were to obstruct the gate as it moves to the zero degree position only the weight and inertia of a single gate would act on the obstruction. However, racers began to learn that they could "drive-through" their individual gate and get an advantage over the other racers as the gates dropped to a bike releasing position. The racer could drive through the gate because to synchronize the individual gates, the actuators were linked to a common exhaust. One racer could push on their gate pushing against the fluid driver actuator and it would push fluid out of the riders actuator and against another racer's actuator through the exhaust. This permitted the rider's gate to begin to transition to the zero degree position while the rest of the gates remained in the upright position. Further, as the racer pushed through his gate, the exhaust from his actuator would back-up in the other actuators and actually inhibit dropping of the other gates.

Further, the start of the race typically uses a starting cadence that prepares the racers for the start of the race. As such, the starting cadence occurs prior to the gate dropping. As the racers became accustomed and familiar with the timing of the cadence, which was typically run from four to seven seconds long, the racers would try to execute a "slingshot." A slingshot is a maneuver where the racers would actually back their bike off the starting gate and then move forward as the gate begins to drop. This slingshot maneuver has been outlawed and sanctioned by officials because it provides racers an unfair starting advantage and is dangerous.

The slingshot can be dangerous if a racer attempts to slingshot out of the starting gate and does the maneuver too early such that the gate does not drop when expected. The racer's forward momentum can cause the racer to fly over the handlebars of the bike, which remains stationary because of the gate, and topple over the gate. Unfortunately, this frequently positions the racer inline with the gate, which will imminently drop and strike the racer and potentially cause serious injury, as indicated previously. While it is illegal in many races, racers still attempt the maneuver as it can provide a substantial advantage if executed successfully.

There exists, therefore, a need in the art for an improved starting gate and method of operating a starting gate that combat these problems identified above.

BRIEF SUMMARY OF THE INVENTION

The invention provides an improved starting gate apparatus and method, through use of a gate actuation arrangement that permits varying at least one gate actuation parameter, such as, the location of an intermediate stopping position along a gate travel path, the magnitude and direction of actuation forces applied to the gate along the gate travel path, and/or the duration and/or disposition of an interval between initiation of an actuation sequence and actuation of the gate of the starting gate.

In one form of the invention, a gate actuation arrangement includes a flexible linkage that couples an actuator to the gates. The flexible linkage permits the gate to stop at intermediate stopping positions defined by obstructions within the gate travel path. In a further form, while one gate is stopped at an intermediate stopping point, other gates are permitted to travel to a bike releasing position. The flexible linkage may be configured to translate an external load applied to one gate by a racer to drive the gate to the bike releasing position to the other gates. In some forms of the invention, each gate is permitted to pivot through a corresponding release hinge in a gate closing direction being opposite a gate opening direction independent of pivoting of the other gates.

In another form of the invention, the gate actuation arrangement varies the driving of the gates as they travel from the bike stopping position to a bike releasing position. More particularly, the gate actuation arrangement may be configured to initially urge the gates toward the bike releasing position for a first period, urge the gates toward the bike stopping position for a second period, and then apply a gate locking force that maintains the gate in a bike releasing position. A gate actuation arrangement, according to the invention may include a programmable controller. The controller may be programmed with user determined lengths of times for the first and second periods, user determined values of gate displacement for the first and second periods or a combination of lengths of times and amounts of gate displacement.

A gate actuation arrangement, according to the invention, may vary the duration and/or the disposition of an interval of a gate actuation sequence. Preferably, the gate actuation arrangement randomly varies an interval between initiation of the gate actuation sequence and actuation of the gate. More preferably, the interval that is randomly varied is the period between communication of a race start indicator and actuation of the gate. The race start indicators may be sounds or lights. Gate actuation arrangements having a programmable controller may include a double layer random number generator to randomly determine the variable intervals of the gate actuation sequence.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
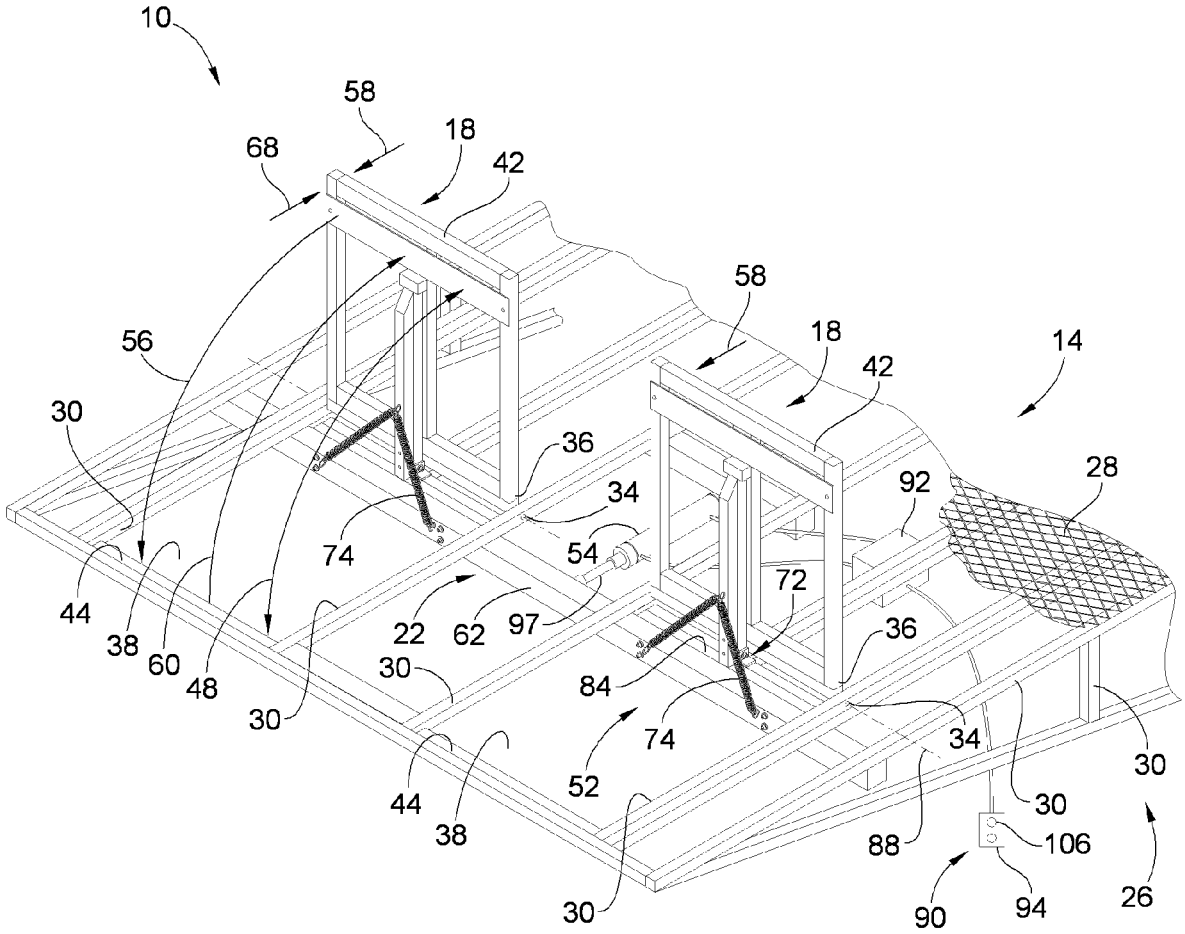
FIG. 1 is a perspective top view of an embodiment of a starting gate for bicycle races in accordance with the teachings of the present invention, the starting gate being in a pre-race state with the gates in a bike stopping position.

Referring now to the drawings, FIG. 1 shows a perspective top view of an exemplary embodiment of a starting gate 10 for bicycle racing according to the teachings of the present invention. The starting gate 10 generally comprises a main platform 14, a plurality of gates 18 and a gate actuation arrangement 22.

The main platform 14 includes a frame 26 that supports a top panel, illustrated in the form of grating 28, to form a support for bicycle racers (not shown). To more clearly illustrate the structure of the starting gate 10, the grating 28 is only illustrated on part of the frame 26. However, it will be understood that the grating 28 typically covers the entire frame 26. The frame 26 includes a plurality of interconnected structural members 30 that are preferably formed from metal to provide sufficient rigidity to the structure and support for the grating 28. In the exemplary embodiment, the frame 26 is formed from extruded rectangular aluminum bars that include T-shaped slots running the length of the bars. However, the frame 26 could be formed from other materials that provide sufficient rigidity and strength. The structural members 30 of the frame 26 may be welded, bolted, screwed, or otherwise secured together. The main platform 14 may be wedge shaped such that the grating 28 is supported at an incline relative to the ground surface on which the starting gate 10 rests.

The grating 28 may be formed from metal, plastic, wood or other sufficiently rigid material to support the racers. The grating 28 includes a plurality of apertures to reduce the weight of the main platform 14, provide increased gripping to prevent racers from slipping, and generally facilitate cleaning of the main platform 14. Depending on the material used, the grating 28 may be welded, bolted, screwed, or otherwise fastened to the structural members 30 of the frame 26. While the top panel of the illustrated embodiment uses grating 28, other embodiments of the main platform 14 could incorporate top panels that are not grating and are continuous sheeting. As such, the top panel could be formed from wood such as plywood or particle board sheets.

The gates 18 pivotally attach to the main platform 14 by hinges 34 proximate hinged end 36 of the gate 18. Each gate 18 pivots about axes 88 defined by the hinges 34 between a bike stopping position, i.e. a generally upright position, and a bike releasing position, i.e. a generally down position (see FIG. 2). When the gates 18 are in the bike stopping position, the gates 18 extend at an angle relative to the grating 28 of the main platform 14 to provide a barrier that generally defines an equal starting point for all racers. The racers position and abut and/or urge the front wheel of their bikes against the gates 18, with the gates 18 thereby preventing the racers from prematurely traversing the starting line prior to the start of a race. In the exemplary embodiment, the gates 18 extend at an angle of approximately ninety degrees relative to the grating 28, however other gate-to-grating 28 angles may be used in practicing the present invention.

Figure 2:
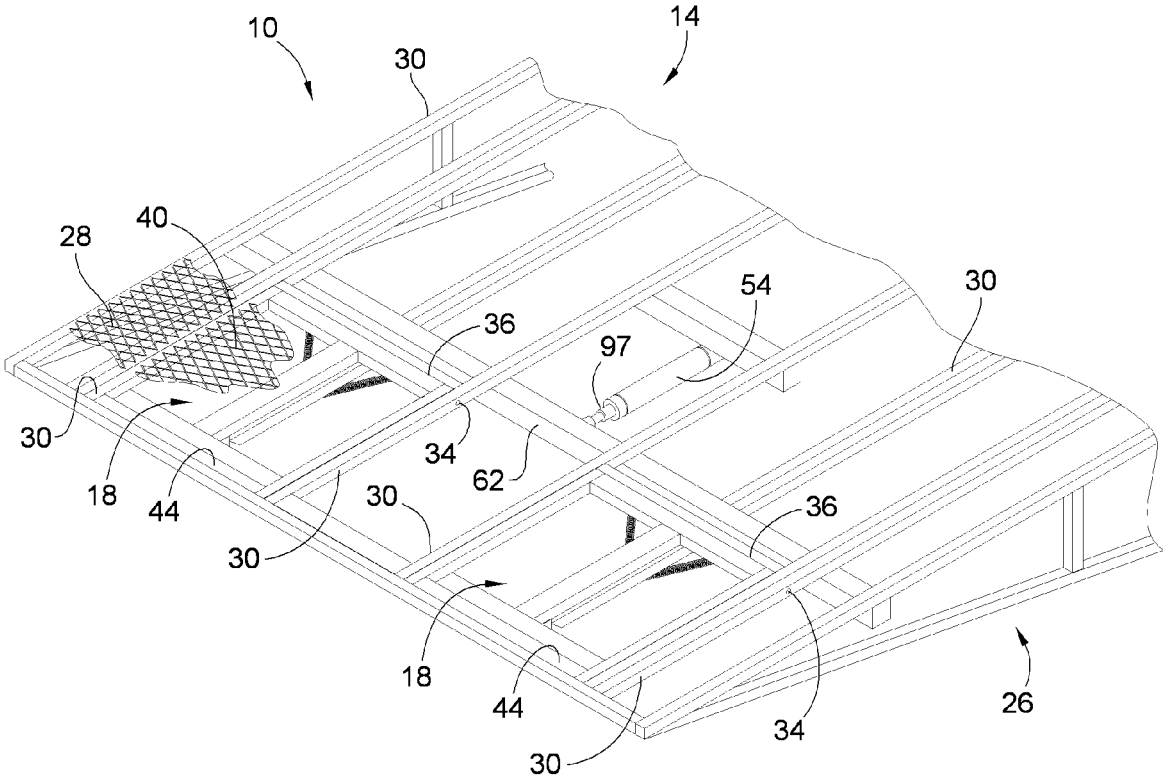
FIG. 2 is a perspective view of the starting gate of FIG. 1 illustrating the gates in a bike releasing position.

Referring additionally to FIG. 2, the gates 18 are illustrated in the bike releasing position. In this position, the gates 18 have pivoted through hinges 34 into gate openings 38 formed in the grating 28 and between adjacent structural members 30 of the frame 26. A top panel of the gate 18 illustrated as grating 40 of the gates 18 is substantially planar with grating 28 of the main platform 14 in the bike releasing position. This planar relationship permits a bike to traverse the gate 18 smoothly and easily when beginning the race. Typically, the free end 42 of the gate 18, the end opposite the hinged end 36, rests on a shelf 44 (see FIG. 1) formed between the two adjacent structural members 30 in the bike releasing position. The shelf 44 may extend around more than just one side of the opening 38 to support the gate 18. The support of shelves 44 prevent the gates 18 from pivoting too deep into openings 38 in the bike releasing position.

Returning primarily to FIG. 1, a gate actuation arrangement 22 operably coupled to the gates 18 actuates the gates 18 between the bike stopping position (FIG. 1) and the bike releasing position (FIG. 2) along a gate travel path (illustrated by double headed arrow 48) defined between those two positions. The gate travel path 48 is arc shaped and is generally a quarter circle, i.e. 90 degrees. As will be more fully discussed below, the gate actuation arrangement 22 actuates the gates 18 along the gate travel path 48 in accordance with a gate actuation sequence. The gate actuation arrangement 22 according to an embodiment of the present invention, beneficially, is configurable to vary at least one parameter of the actuation of the gates 18 from the bike stopping position to the bike releasing position. These parameters, include, for example, the location of an intermediate stopping point of the gate 18 along the gate travel path 48, the magnitude and duration of actuation forces applied the gates 18 along the gate travel path 48, and the duration and disposition of an interval between initiation of the actuation sequence and actuation of the gates 18.

The gates 18 are urged to move along the gate travel path 48 via cooperation of the hinges 34 and the gate actuation arrangement 22. In the illustrated embodiment, gate actuation arrangement 22 includes a flexible linkage 52 that operably couples an actuator, illustrated in the form of a cylinder 54, to the gates 18. Other actuators may be incorporated for assisting driving the gates 18 and the cylinder 54 could be hydraulic or pneumatic. Further, when more than two gates 18 are provided, more than one cylinder 54 may be used to drive the gates 18. The cylinder 54 provides at least part of the load to drive the gates 18 in a gate opening direction illustrated as arrow 56 that extends in a direction extending from the bike stopping position to the bike releasing position. Typically, the gates 18 are additionally actuated in the gate opening direction 56 by assistance of gravity and forces directly applied to individual gates 18 by the racers via their bicycles, represented by arrow 58.

In the exemplary embodiment of the gate actuation arrangement 22, the cylinder 54 is used to reset the gates 18 to the bike stopping position. The cylinder 54 provides a load to drive the gates 18 in a gate closing direction, illustrated as arrow 60, being opposite the gate opening direction 56.

In the illustrated embodiment, the cylinder 54 retracts to drive the gates 18 in the gate opening direction 56 and extends to drive the gates 18 in the gate closing direction 60. However, it will appreciated that other actuator configurations can be used in practicing embodiments of the invention, for example the reverse configuration.

Prior to driving the gates 18 to the bike releasing position, the cylinder 54 is in a first state, namely an extended state where the ram 97 of the cylinder 54 is extended. After driving the gates 18 to the bike releasing position, the cylinder 54 is in a second state, namely a retracted state where the ram 97 is retracted.

So that the cylinder 54 simultaneously drives all gates 18 during normal operation, the flexible linkage 52 includes a linking bar 62 interposed between and operably coupling each gate 18 to one another as well as cylinder 54. The linking bar 62 translates the loads provided by the cylinder 54 to each of the gates 18. The linking bar 62 also translates any forces 58 applied by an individual racer attempting to drive through a gate 18 to the other gates 18. This prevents that racers gate 18 from moving ahead independently of the other gates 18. This feature diminishes any advantage that a racer might gain by attempting to driving through his gate 18.

Figure 3:
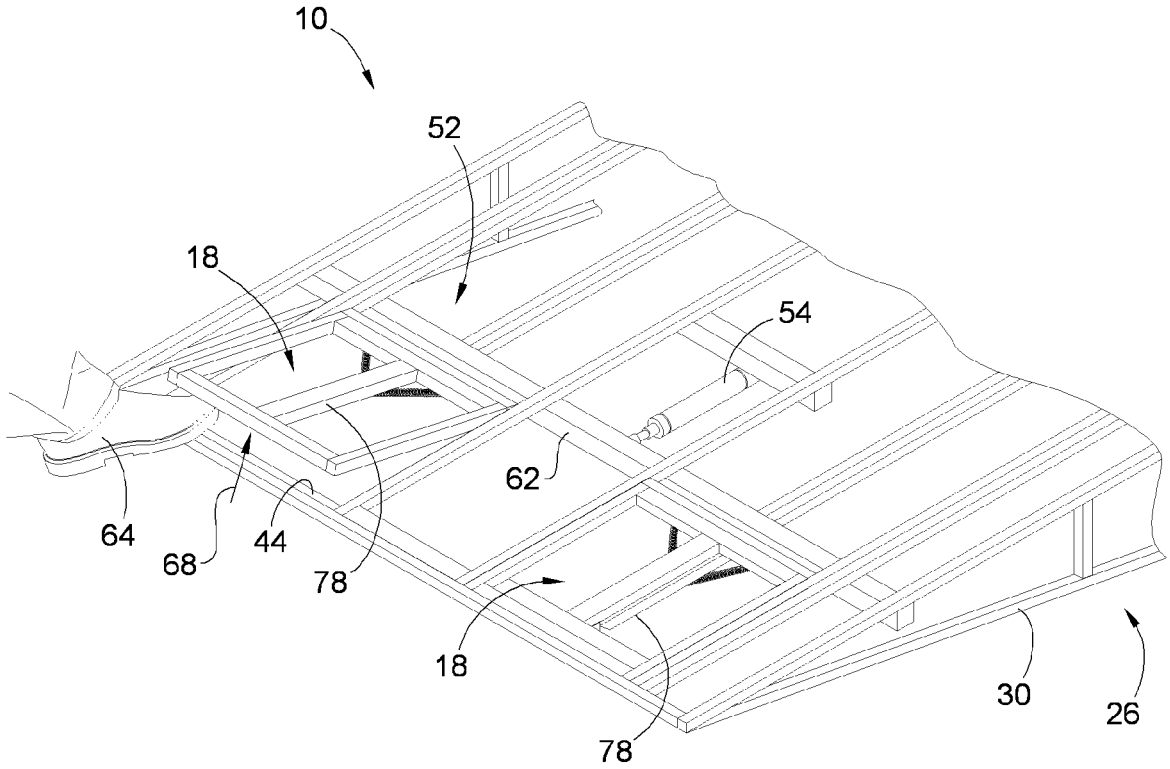
FIG. 3 is a perspective view of the starting gate of FIG. 1 illustrating one gates in a bike releasing position and another gate contacting an obstruction and being at an intermediate stopping position.

In the exemplary embodiment, the flexible linkage 52 is configured to prevent injury or damage to obstructions 64, i.e. objects such as bicycles or racers, that happen to obstruct a gate 18 as it travels in the gate opening direction 56 along the gate travel path 48 to the bike releasing position, as illustrated in FIG. 3. The flexible linkage 52 permits each gate 18 that encounters or contacts an obstruction 64 during gate actuation to stop at an intermediate stopping position, as illustrated in FIG. 3. Typically, the intermediate stopping position is defined by the position and/or size of the obstruction 64. Thus, the flexible linkage 52 permits the intermediate stopping position to vary depending on the size and/or position of the obstruction 64 encountered by the gate 18 in the gate opening direction 56. As further illustrated in FIG. 3, while the flexible linkage 52 permits the gate 18 that contacts the obstruction 64 to stop at the intermediate stopping position, the cylinder 54 is permitted to continue to transition to the retracted state and continue to drive the other gate 18 of the starting gate 10 along the gate travel path 48 to the bike stopping position.

Figure 5:
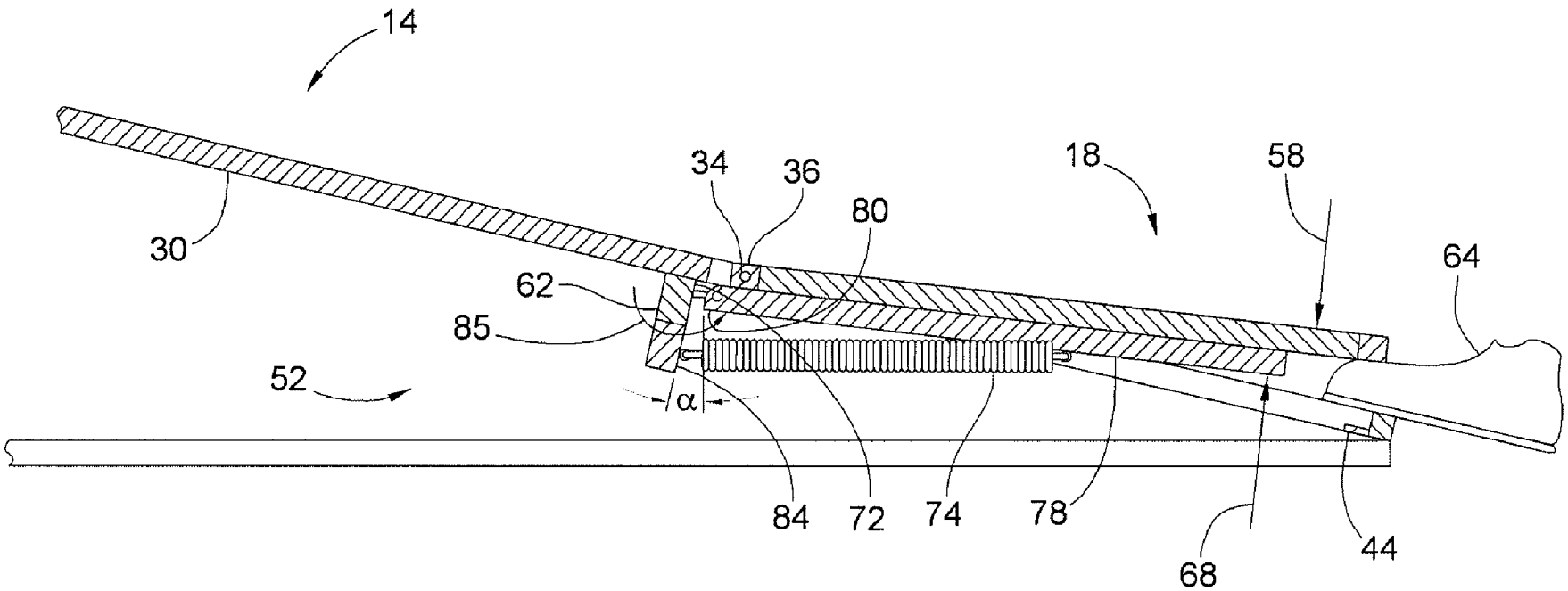
FIG. 5 is a cross-sectional partial illustration of one of the gates of the starting gate of FIG. 1, the gate shown in an intermediate stopping position with the gate pivoting through a release hinge relative to the linking bar as it contacts an obstruction.
Figure 6:
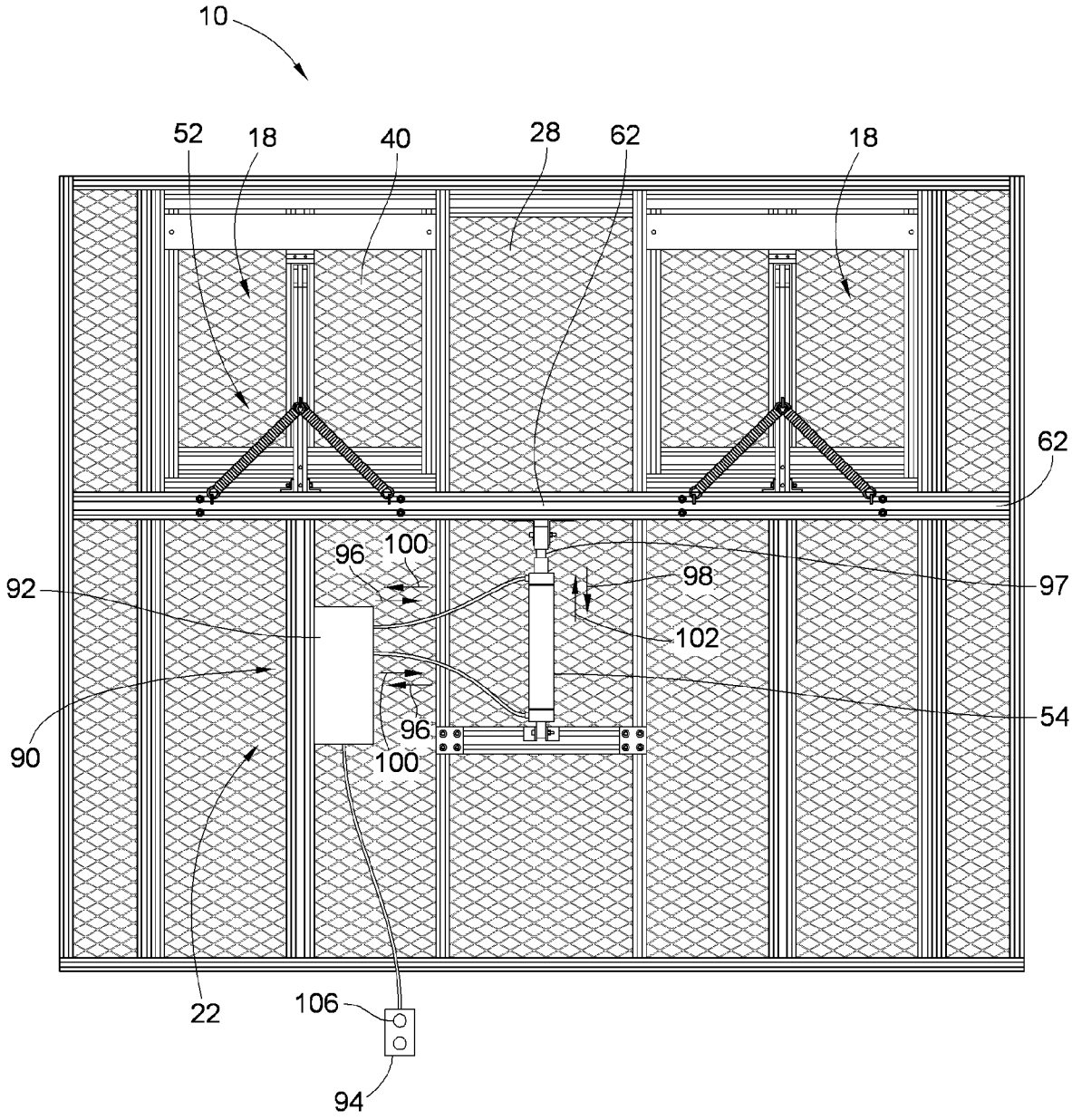
FIG. 6 is a bottom illustration of the starting gate of FIG. 1.

As illustrated in FIG. 5, the gate 18 may pivot via hinge 72 to an angle a defined by the size and position of the obstruction 64.

With reference to FIGS. 1 and 3, to permit only the gate 18 that is obstructed by the obstruction 64 to stop at the intermediate stopping position, the flexible linkage 52 is configured such that each gate 18 can pivot in the gate closing direction 60 relative to the other gates 18 when an external load, illustrated as arrow 68 is applied acting in the gate closing direction 60 to any one of the gates 18. The gates 18 may therefore move in the gate closing direction 60 independent of the other gates 18.

Figure 4:
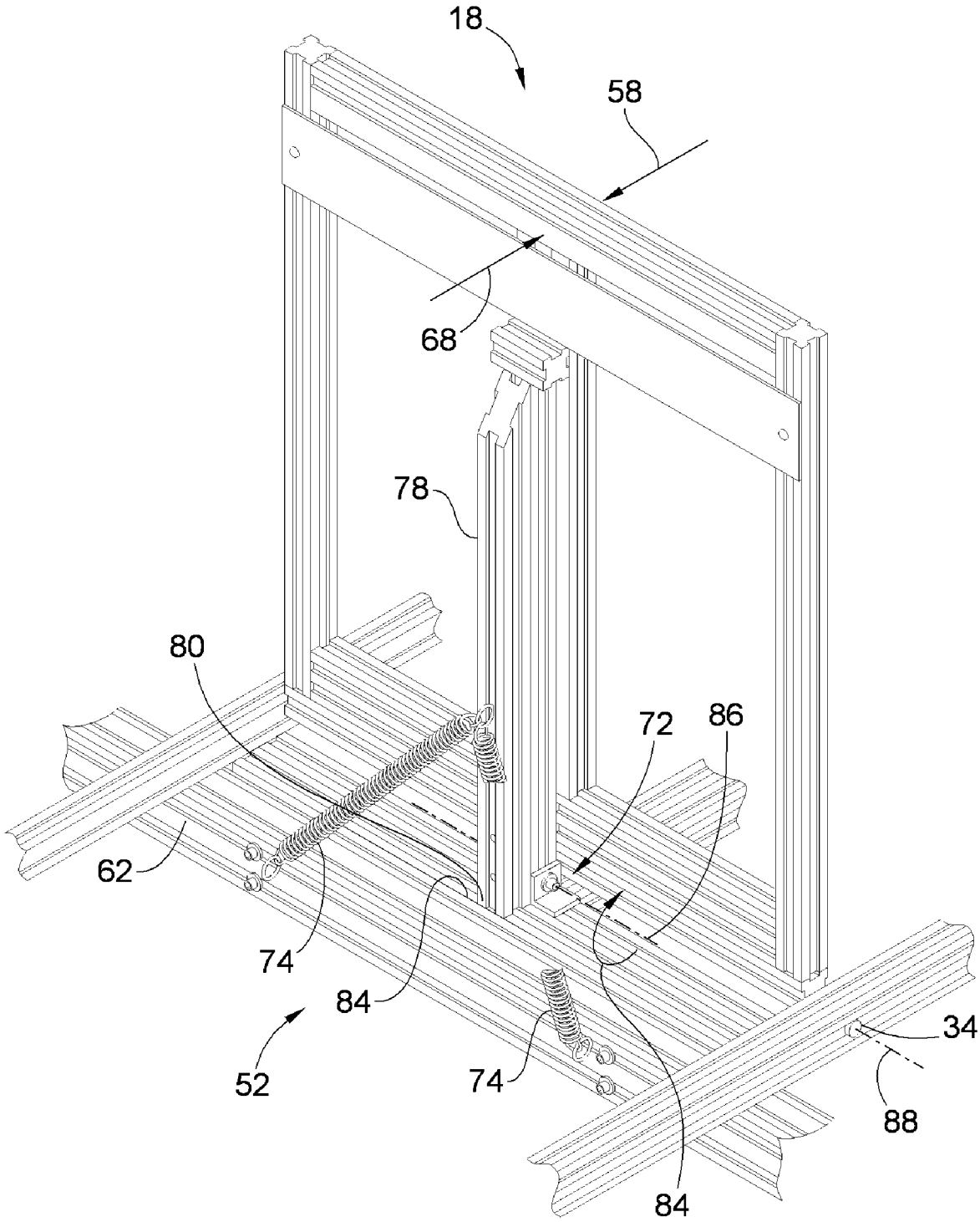
FIG. 4 is a perspective partial illustration of one of the gates of the starting gate of FIG. 1, the gate shown in the bike stopping position.

To provide this independent movement in the gate closing direction 60, the flexible linkage 52 further includes release hinges 72 interposed between and operably coupling the linking bar 62 to individual gates 18, as best illustrated in FIGS. 1, 4 and 5. The flexible linkage 52 further includes a biasing member, in the form of two coil springs 74 connected between the frame of the gate 18 and particularly structural member 78 of the gate 18 and the linking bar 62. The coil springs 74 are positioned such that an abutment portion of the gate 18, formed by an abutment end 80 of structural member 78 is biased against an abutment portion of the linking bar 62, illustrated as surface 84 of the linking bar 62. The springs 74 maintain the corresponding abutment portions proximate one another while the gates 18 are actuated. In this embodiment, the linking bar 62 acts as an abutment member as it abuts with the abutment end 80 of structural member 78. The abutment portions need not be surfaces.

It will be recognized that the coil springs 74 bias the gate 18 about release hinge 72 so that the abutment end 80 engages the abutment surface 84. As such, the cooperation of the biasing provided by coil springs 74 and the interference between abutment end 80 and linking bar 62 maintains the gate 18 in relative positions to one another. However, this relative position can be overcome by application of an external load 68 that is greater than and in the opposite load direction than the load provided by coil springs 74. When load 68 provides a greater torque about release hinge 72 than coil springs 74, the gate 18 will pivot via release hinge 72 relative to linking bar 62 in a release direction 85, illustrated as arrow 84 in FIGS. 4 and 5. To permit rotation in the release direction 85, the interference between the abutment end 80 and the linking bar 62 is offset from and only occurs on one side of axis 86. If the interference occurred on both sides of axis 86, the gate 18 would not be able to pivot via release hinge 72 in the release direction 85 and would be in a permanent position relative to linking bar 62.

It is a benefit of the present flexible linkage 52 that a force applied by any of the racers in the gate opening direction 56, i.e. a load 58, forces the abutment 80 into the linking bar 62 at the interference and translates this load 58 to the other gates 18 in the gate opening direction 56. As such, any unfair advantage that a racer tries to get by pressing against his gate 18 to drive it toward the bike releasing position prior to the start of the race also acts to drive the other gates 18 of the other racers toward the bike releasing position.

However, because of the release hinges 72, an external load applied to the gate 18 in the opposite direction, i.e. such as external load 68 applied by an obstruction 64 in the gate travel path 48, that particular gate 18 can independently stop at an intermediate stopping position defined by the obstruction 64 applying load 68 without substantially affecting the travel of the other unobstructed gates 18, as illustrated in FIG. 3. Further, it should therefore be understood that the only load applied to the obstruction 64 by the gate 18 at the intermediate stopping position is the weight of that individual gate 18 and the load applied by the stretched coil springs 74. It should be also understood that the load applied by the cylinder 54 is the load applied by the coil springs 74.

The net load acting on the obstruction 64 is significantly less than in prior art devices where only a single long gate (i.e. a gate for multiple racers) acted on an obstruction. With the starting gate 10 according to the present invention, the gravitational weight load of the single gate 18 is significantly less than the gravitational weight load of all the gates (or a single long gate such as when used with eight (8) racers), which, as mentioned previously, may range anywhere from 150-600 lbs, the entire load of the cylinder 54 trying to drive the gate 18 to the bike releasing position is limited to the spring force of coil springs 74 and the weight of any racers that are riding over the other gates 18 are not applied to the obstruction 64, all of which acted on the obstruction in the past. Similarly, the flexible linkage 52 acts to remove the inertia of the other gates 18 from the gate 18 directly acting on the obstruction as the gate contacts the obstruction 64 via inclusion of the release hinge 72.

The gate actuation arrangement 22 can also vary the actuation of the gates 18 along the gate travel path 48. More particularly, the gate actuation arrangement 22 can be configured to drive or accelerate the gates 18 in the gate opening direction 56 for a first period, reverse the direction of actuation to drive the gates 18 in the gate closing direction 60 for a second period thereby to decelerate the gates when viewed in the gate opening direction 56 and then again drive the gates 18 in the gate opening direction 56 to lock the gates 28 in the bike releasing position until the gates 18 are reset to the bike stopping position. This alternating, or reversing of, actuation of the gates 18 between a gate opening direction 56 and a gate closing direction 60 can be referred to as "reverse bump" actuation.

This reverse bump actuation acts to reduce the rate of speed, and therefore inertia, at which the gates 18 approach the bike releasing position and contact shelf 44. This reduced inertia and speed of the gates 18 as they contact shelf 44 thereby reduces the force and consequently the noise and potential damage to the starting gate 10 associated with contact between the gates 18 and shelf 44. In some embodiments, the reverse bump can be used to reduce the noise to approximately 83 db measured in the A scale at the rider's position. Also, the gates 18 are made safer to racers as the speed of the gates 18 is reduced if a racer were accidentally to get in the gate travel path 48 as the gate 18 is actuated from the bike stopping position to the bike releasing position.

In the exemplary embodiment, the reverse bump actuation occurs by reversing the direction of supplying an actuation fluid to the cylinder 54. With reference to FIG. 1, which is a bottom illustration of the starting gate 10, a control arrangement 90 is illustrated in simplified form. The exemplary embodiment of the control arrangement 90 includes a fluid supply 92 and a controller 94. The fluid supply 92 can include such components as valves, fluid supply reservoirs, fluid exhaust manifolds, fluid hoses, etc. and is operably coupled to the cylinder 54. The fluid supply 92, of the exemplary embodiment, includes one or more electronic solenoid activated valves that can be electrically operated to reverse fluid flow to the cylinder 54.

During the first period, the actuation fluid flows (illustrated by arrows 96) to cause the cylinder 54 to retract ram 97 in the direction of arrow 98 and drive the gates 18 in the gate opening direction 56. During the second period, the actuation fluid flows (illustrated by arrows 100) in a reverse direction to provide a fluid pulse to extend the ram 97, illustrated as direction 102. Then after the second period, the fluid flow is reversed again to the original flow direction 96 to retract the ram 97 to ultimately drive the gates 18 in the gate opening direction 56 to the bike releasing position and to maintain or lock the gates in that position until being reset.

It should be noted that in some embodiments, the reverse bump need not actually literally reverse the flow of the fluid to the cylinder 54. The reverse bump may be effectuated by merely stopping fluid flow to the cylinder 54 such that a vacuum is created or the fluid flow is reduced momentarily. The vacuum or reduced fluid flow acts against the driving inertia of the cylinder 54 and inertia of the gates 18 to effectively apply a load in the opposite direction and decelerate the gates 18. Actuation in the gate closing direction 60 and flow in a reverse direction will be broad enough to include such a creation of a vacuum or halting actuation in the gate closing direction 60, even though the fluid may not actually flow in a reverse direction or literally drive the cylinder 54 in the opposite direction, the mere interruption in driving the cylinder 54 in the gate opening direction 56 is sufficient.

The gate actuation arrangement 22 is selectively configurable to vary the first and second periods to vary the actuation of the gates 18 based on such factors as gate weight, desired length of gate actuation between the bike stopping position and the bike releasing position, the desired gate speed and impact at the bike releasing position, and numerous other factors. The periods may be defined by lengths of time or displacement of the gates 18 along the gate travel path 48.

For example, if it takes 200 milliseconds to actuate the gate 18 from the bike stopping position to the bike releasing position without any reverse bump employed, when the reverse bump is employed, the first period may last for 170 milliseconds, the second period may last for 30 milliseconds and thereafter the cylinder 54 drives the gates 18 to the bike releasing position. This configuration may result in the reverse bump being applied too late such that it has limited effect on the actuation of the gates 18 and the gates 18 still slam into the shelves 44 with large speed and force thereby resulting in a loud noise and increased potential for injury. The operator may accordingly alter the periods to 1) decrease the first period to, for example, 150 milliseconds, 2) increase the second period to, for example, 50 milliseconds, or 3) a combination of 1) and 2). Depending on the number and weight of gates 18 being actuated, these periods can be adjusted to compensate for changes in inertia of the gates 18 and to develop a desired actuation of the gates.

While the periods may be varied based on timed intervals, alternative embodiments may base the periods on angular position of the gates 18. The first period of actuation may last until the gates 18 travel approximately 75 degrees, then the second period may last for approximately 1 degree. Alternatively, the first and second periods could be dissimilar such that one is based on time while the other is based on angular position of the gates 18. When using angular position to set the periods, a sensor or other meter for determining the angular position of the gates 18 may be incorporated.

In the exemplary embodiment, the control arrangement 90 includes a controller 94 that controls the cylinder 54 by controlling the fluid supplied to the cylinder 54 by the fluid supply 92. The controller 94, in the exemplary embodiment, is an electronic controller that includes storage memory that can be selectively programmed with varied predetermined values for the first and second periods. As such, the actuation profile of the cylinder 54 can conveniently be varied or otherwise calibrated by selectively reprogramming the controller 94, namely the predetermined values for the first and second periods. Typically, the values will be time values and will be increments of 10 milliseconds, however other time intervals may be used. Further, the periods may be varied by simply repeatedly pressing button 106 of the controller 94 to reprogram the controller 94.

Alternatively, the controller may be configured to vary the fluid flow supplied by the fluid supply 92. More particularly, the controller may be selectively configured to limit the open or closing range of any valves of the fluid supply 92 to reduce the fluid flow rate therethrough and, thus, to and from the cylinder 54. This can be used to reduce or increase the pressure of the fluid downstream from any such valves acting on the cylinder 54.

In some embodiments of the present invention is that the gate actuation arrangement 22 may be configured to vary the gate actuation sequence. As discussed previously, after experiencing numerous races, racers can begin to or believe that they can time the actual actuation of the gates 18 as a result of a race starting cadence to get a better start relative to the other racers. The ability to vary the pattern of starting races by varying the gate actuation sequence can dissuade racers from attempting the slingshot maneuver discussed previously. This reduces unfair advantages and hopefully prevents some racers from attempting the slingshot maneuver and thereby reducing the potential for accidents relating to racers falling over the gates 18 into the gate travel path 48.

The gate actuation arrangement 22 of the exemplary embodiment, uses the electronic controller 94, discussed previously, to randomly generate the duration and disposition of intervals for the gate actuation sequence. A typical gate actuation sequence is illustrated by timeline 108 in FIG. 7. The gate actuation sequence includes several time points including: initiation 110 of the sequence, which is typically done by pressing a button 106 of the controller 94, communication 112 of at least one race starting indicator, which is typically a cadence communicated by a series of lights, a speaker, or a combination thereof, actuation 114 of the gates, stoppage 116 of the gates at the bike releasing position and reset 118 of the gates 18 to the bike stopping position. A slight variation in the sequence may occur when an obstruction 64 is encountered by any one gate 18 and this is illustrated at stoppage 120 at the intermediate stopping position illustrated using dashed lines, because it is a non-typical event. Further, additional events may occur during the gate actuation sequence. Such as, when the sequence includes stoppage 120 at the intermediate stopping position, the sequence may additionally include restarting 122 actuation of the gates 18 along the gate travel path 48.

The typical interval that is altered to provide random race starts is the interval between communication 112 of the race start indicators and actuation 114 of the gates 18. In the exemplary embodiment, the controller 94 includes a double layer random number generator that "randomly" generates a time interval between the initiation of the starting sequence and actuation of the gates 114. The double layer random number generator selects a seed number when the operator starts the gate actuation sequence (typically between 1 and 65,000). More particularly, when the controller 94 is powered on, the controller 94 runs a counter that cycles from 1 to 65,000 (however, other numerical cycles may be employed). When the operator presses a button 106 of the controller 94 to initiate the gate actuation sequence, the number in the counter becomes the seed number. This seed number is used in a random number generator to determine a "random" time interval.

When the random time interval is the time between communication 112 of the start indicators and the actual actuation 114 of the gates 18, the time interval is preferably varied between one-half a second and two and a half seconds. However, other time intervals can be used. As such, once the operator initiates the gate actuation sequence by pressing the button 106 on the controller 94, the controller 94 randomly generates a time interval between the last race start indicator and the time at which the gates are actuated. Once the last race start indicator is communicated to the racers and the randomly generated interval elapses, the controller 94 activates the gates 18. At that point, the gates 18 are actuated by the gate actuation arrangement 22 and more particularly by cylinder 54 from the bike stopping position to the bike releasing position and the race begins. After a sufficient period of time the gates 18 may automatically reset in preparation for another race, or the operator may be required to push a button 106 causing the cylinder 54 to reset the gates 18 to the bike stopping position.

Figure 7:
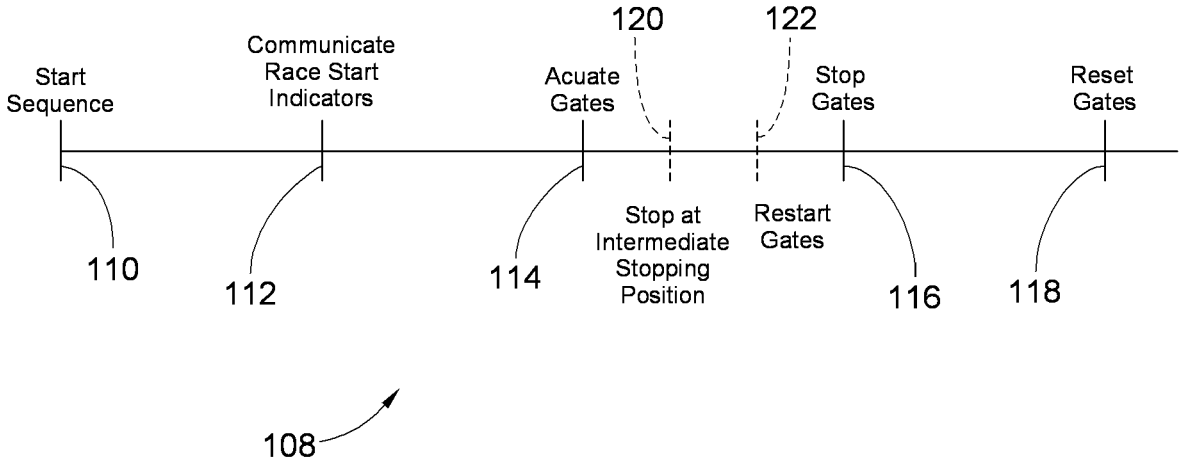
FIG. 7 is a simplified timeline illustrating a gate actuation sequence for driving the gates of the starting gate of FIG. 1 to a bike releasing position, according to the teachings of the present invention.

While the exemplary gate actuation sequence, as illustrated in FIG. 7, includes communicating 112 the race starting indicators, one of ordinary skill in the art will recognize that some gate actuation sequences according to the present invention will not include that event. In such a gate actuation sequence, the controller 94 will typically vary the duration of the time between initiation 110 of the gate actuation sequence and actuation 114 of the gates 18.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A starting gate for bicycle racing comprising:

a main platform having a top surface upon which the bike sits prior to the starting of the bicycle race;

at least one gate, the gate pivoting relative to the main platform; and a gate actuation arrangement for driving the at least one gate between a bike stopping position in which the at least one gate forms an obstruction preventing the bike from exiting the main platform to a bike releasing position in which the bike is permitted to exit the main platform along a gate travel path, in accordance with a gate actuation sequence including initiation of the actuation sequence and actuation of the gate actuation arrangement, the at least one gate pivoting away from the bike along the gate travel path, the gate actuation arrangement being adapted to selectively vary at least one parameter regarding the actuation of the at least one gate from the bike stopping position to the bike releasing position, the at least one parameter selected from the group consisting of:

a position of an intermediate stopping position of the at least one gate along the gate travel path, the force that urges the at least one gate along the gate travel path, and the duration of an interval of time between initiation of the actuation sequence and actuation of the at least one gate; and wherein the gate actuation arrangement includes an actuator and a flexible linkage operably coupling the actuator to the at least one gate in such a manner that the actuator at least partially drives the at least one gate from the bike stopping position toward the bike releasing position, wherein the at least one parameter selected is the position of an intermediate stopping position of the at least one gate along the gate travel path, and wherein the gate travel path includes the intermediate stopping position defined at a position where the at least one gate contacts an obstruction, wherein the flexible linkage is arranged to permit variation in the intermediate stopping position along the gate opening path relative to at least one of a size or position of the obstruction.

2. The starting gate of claim 1, wherein the actuator has a first state and a second state, the at least one gate being in the bike stopping position when the actuator is in the first state, and the at least one gate being in the bike releasing position when the at least one gate is unobstructed and the actuator is in the second state, and wherein the flexible linkage is arranged in such a manner that the actuator may transition toward the second state while the at least one gate remains stopped at the intermediate stopping position.

3. The starting gate of claim 2, wherein the flexible linkage includes a first release hinge, a first abutment member, and a first biasing member, wherein the first abutment member is operably coupled to the actuator and the first release hinge pivotally connects the first abutment member to the at least one gate and the first biasing member prevents relative motion via the first release hinge between the first abutment member and the at least one gate until the at least one gate contacts the obstruction.

4. The starting gate of claim 3, wherein the at least one gate includes a first abutment portion on a first side of the first release hinge and the first abutment member includes a corresponding second abutment portion on the first side of the first release hinge, the first biasing member maintaining the first and second abutment portions proximate one another until the at least one gate contacts the obstruction.

5. A starting gate for bicycle racing comprising:

a main platform having a top surface upon which the bike sits prior to the starting of the bicycle race;

at least one gate, the gate pivoting relative to the main platform; and a gate actuation arrangement for driving the at least one gate between a bike stopping position in which the at least one gate forms an obstruction preventing the bike from exiting the main platform to a bike releasing position in which the bike is permitted to exit the main platform along a gate travel path, in accordance with a gate actuation sequence including initiation of the actuation sequence and actuation of the gate actuation arrangement, the at least one gate pivoting away from the bike along the gate travel path, the gate actuation arrangement being adapted to selectively at least one parameter regarding the actuation of the at least one gate from the bike stopping position to the bike releasing position, the at least one parameter selected from the group consisting of:

a position of an intermediate stopping position of the at least one gate along the gate travel path, the force that urges the at least one gate along the gate travel path, and the duration of an interval of time between initiation of the actuation sequence and actuation of the at least one gate; and wherein the at least one gate includes a plurality of gates, each gate moveable relative the main platform between a bike stopping position and a bike releasing position, the gate actuation arrangement including an actuator for, at least partially, driving the gates between the bike stopping position and the bike releasing position, a flexible linkage disposed between each of the gates and the actuator, the linkage coupling the gates together in such a manner that the plurality of gates may be actuated toward the bike releasing position simultaneously, the flexible linkage coupling the gates in such a manner that each gate may independently rotate in a gate closing direction extending from the bike releasing position toward the bike stopping position, the independent rotation permitting each gate to stop at variable intermediate stopping positions when a gate contacts an obstruction independent of positions of the other gates.

6. A starting gate for bicycle racing comprising:

a main platform having a top surface upon which the bike sits prior to the starting of the bicycle race;

at least one gate, the gate pivoting relative to the main platform; and a gate actuation arrangement for driving the at least one bike gate between a bike stopping position in which the at least one gate forms an obstruction preventing the bike from exiting the main platform to a bike releasing position in which the bike is permitted to exit the main platform along a gate travel path, in accordance with a gate actuation sequence including initiation of the actuation sequence and actuation of the gate actuation arrangement, the at least one gate pivoting away from the bike along the gate travel path, the gate actuation arrangement being adapted to selectively vary at least one parameter regarding the actuation of the at least one gate from the bike stopping position to the bike releasing position, the at least one parameter selected from the group consisting of:

a position of an intermediate stopping position of the at least one gate along the gate travel path, the force that urges the at least one along the gate travel path, and the duration of an interval of time between initiation of the actuation sequence and actuation of the at least one gate;

wherein the gate actuation arrangement includes an actuator coupled to the at least one gate to app1y a force to the gate to drive the gate from the bike stopping position to the bike releasing position and a control arrangement that is configured to control the actuator, the control arrangement is configured to control the actuator to urge the at least one gate along the gate travel path during the gate actuation sequence by urging the at least one gate in a gate opening direction for a first period to accelerate the at least one gate, the gate opening direction being the direction extending from the bike stopping position to the bike releasing position, the control arrangement is configured to control the actuator to urge the at least one gate along the gate travel path during the gate actuation sequence by urging the at least one gate in a gate closing direction being opposite the gate opening direction for a second period to decelerate the at least one gate, and the control arrangement is configured to control the actuator to urge the at least one gate along the gate travel path during the gate actuation sequence by urging the at least one gate in the gate opening direction; and wherein the control arrangement of the gate actuation arrangement includes a controller adapted to adjust an amount of load driving the at least one gate in the gate closing direction and the gate opening direction.

7. The starting gate of claim 6, wherein the controller is programmable to define a first length of time for the first period and to define a second length of time for the second period.

8. The starting gate of claim 6, wherein the controller is programmable to define a gate displacement along the gate travel path for the first period and to define a length of time for the second period.

9. A starting gate for bicycle racing comprising:

a main platform having a top surface upon which the bike sits prior to the starting of the bicycle race;

at least one gate, the gate pivoting relative to the main platform; and a gate actuation arrangement for driving the at least one gate between a bike stopping position in which at least one gate forms an obstruction preventing the bike from exiting the main platform to a hike releasing position in which the bike is permitted to exit the main platform along a gate travel path, in accordance with a gate actuation sequence including initiation of the actuation sequence and actuation of the gate actuation arrangement, the at least one gate pivoting away from the bike along the gate travel path, the gate actuation arrangement being adapted to selectively vary at least one parameter regarding the actuation of the at least one gate from the bike stopping position to the bike releasing position, the at least one parameter selected from the group consisting of:

a position of an intermediate stopping position of the at least one gate along the gate travel path, the force that urges the at least one gate along the gate travel path, and the duration of an interval of time between initiation of the actuation sequence and actuation of the at least one gate;

wherein the gate actuation arrangement includes an actuator coupled to the at least one gate to apply a force to the gate to drive the gate from the bike stopping position to the bike releasing position and a control arrangement that is configured to control the actuator, the control arrangement is configured to control the actuator to urge the at least one gate along the gate travel during the gate actuation sequence by urging the at least one gate in a gate opening direction for a first period to accelerate the at least one gate, the gate opening direction being the direction extending from the bike stopping position to the bike releasing position, the control arrangement is configured to control the actuator to urge the at least one gate along the gate travel path during the gate actuation sequence by urging the at least one gate in a gate closing direction being opposite the gate opening direction for a second period to decelerate the at least one gates and the control arrangement is configured to control the actuator to urge the at least one gate along the gate travel path during the gate actuation sequence by urging the at least one gate in the gate opening direction; and wherein the actuator of the gate actuation arrangement is operably connected to the at least one gate to provide a driving load that, at least partially, drives the gate in the gate opening direction for the first period and subsequent to the second period, and a driving force in the gate closing direction for the second period, and the control arrangement includes a controller for controlling actuation of the actuator during the gate actuation sequence.

10. The starting gate of claim 9, wherein the controller is programmable to adjust the first and second periods.

11. The starting gate of claim 9, wherein the, the controller includes an input for an operator to initiate the gate actuation sequence, the controller employing a double layer random generator to provide a random interval between the operator initiation of the gate actuation sequence and actuation of the gate actuation arrangement.

12. The starting gate of claim 11, wherein the gate actuation sequence includes first and second race starting indicators that are communicated to the racers, between initiation of the gate actuation sequence and actuation of the gate actuation arrangement, wherein the double layer random generator is employed to randomly vary the time interval between the race starting indicators and the actuation of the gate actuation arrangement.

* * * * *